US008083882B2

(12) United States Patent
Rosenfeld

(10) Patent No.: US 8,083,882 B2
(45) Date of Patent: Dec. 27, 2011

(54) METHOD OF ADAPTING A PAINT TRANSFER IMAGE TO THE GENERATION OF A MURAL

(76) Inventor: Jerry Rosenfeld, Red Bank, NJ (US)

( * ) Notice: Subject to any disclaimer, the term of this patent is extended or adjusted under 35 U.S.C. 154(b) by 0 days.

(21) Appl. No.: 12/835,792

(22) Filed: Jul. 14, 2010

(65) Prior Publication Data

US 2010/0276058 A1 Nov. 4, 2010

Related U.S. Application Data

(60) Division of application No. 10/847,435, filed on May 17, 2004, now abandoned, which is a continuation of application No. 10/308,231, filed on Dec. 2, 2002, now abandoned.

(60) Provisional application No. 60/337,907, filed on Dec. 3, 2001, provisional application No. 60/409,646, filed on Sep. 10, 2002.

(51) Int. Cl.

| | |
|---|---|
| ***B44C 1/17*** | (2006.01) |
| ***B44C 1/24*** | (2006.01) |
| ***B41M 3/12*** | (2006.01) |
| *B44C 1/28* | (2006.01) |
| *B41M 3/06* | (2006.01) |

(52) U.S. Cl. ..... 156/240; 156/230; 427/146; 427/147; 427/148; 427/152

(58) Field of Classification Search ..... 156/230, 156/240; 427/146–148, 152
See application file for complete search history.

(56) References Cited

U.S. PATENT DOCUMENTS

| | | | | |
|---|---|---|---|---|
| 1,475,922 | A * | 11/1923 | Soglow | 428/48 |
| 1,648,020 | A | 1/1927 | Labram | |
| 3,785,912 | A | 1/1974 | Van Deusen | |
| 3,875,716 | A | 4/1975 | Eusemann | |
| 4,353,759 | A * | 10/1982 | Stallings | 156/64 |
| 4,650,704 | A | 3/1987 | Rothenberg | |
| 4,661,182 | A * | 4/1987 | Lerner | 156/94 |
| 4,804,572 | A | 2/1989 | Bodrogi | |
| 4,879,161 | A | 11/1989 | Raymond et al. | |
| 4,900,604 | A * | 2/1990 | Martinez et al. | 428/79 |
| 5,196,246 | A | 3/1993 | Kauss et al. | |
| 5,225,170 | A * | 7/1993 | Kolk et al. | 422/186.3 |
| 5,263,529 | A | 11/1993 | Landis | |
| 5,266,381 | A | 11/1993 | Simon | |
| 5,491,006 | A | 2/1996 | Johnson et al. | |
| 5,523,129 | A | 6/1996 | McGeehan-Hatch | |
| 5,620,764 | A | 4/1997 | Schwarz et al. | |
| 5,830,529 | A * | 11/1998 | Ross | 427/152 |
| 6,045,639 | A | 4/2000 | Davis | |
| 6,110,317 | A | 8/2000 | Sandor | |
| 6,346,312 | B1 | 2/2002 | Billoni | |

(Continued)

FOREIGN PATENT DOCUMENTS

| | | | |
|---|---|---|---|
| EP | 968845 | A2 | 1/2000 |

(Continued)

*Primary Examiner* — Sonya Mazumdar
(74) *Attorney, Agent, or Firm* — Wall & Tong, LLP

(57) ABSTRACT

A method for creating imagery on a surface by establishing a visual boundary between two surface color regions and applying a dry transfer object proximate the visual boundary such that when the dry transfer object is substantially the same color as one of the surface regions, a negative space effect is created within the second surface color region to define thereby a desired image.

20 Claims, 6 Drawing Sheets

U.S. PATENT DOCUMENTS 6,607,621 B1 * 8/2003 Swanson ..... 156/94
6,703,089 B2 3/2004 DeProspero et al.
7,291,233 B2 * 11/2007 Brigato ..... 156/71
7,423,002 B2 * 9/2008 Shah et al. ..... 510/278
2004/0131769 A1 * 7/2004 Saxon ..... 427/140
2010/0055371 A1 * 3/2010 Edwards et al. ..... 428/41.6

FOREIGN PATENT DOCUMENTS

FR 2076802 A 10/1971

* cited by examiner

FIG. 6A
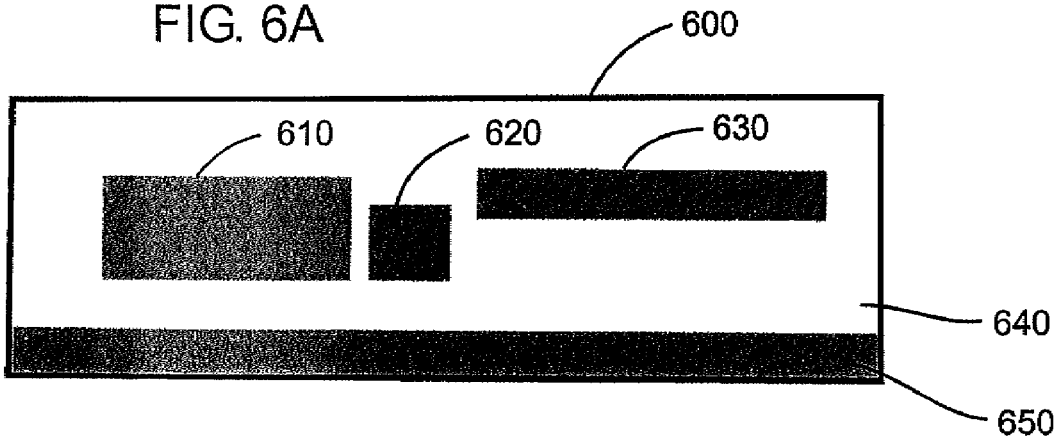
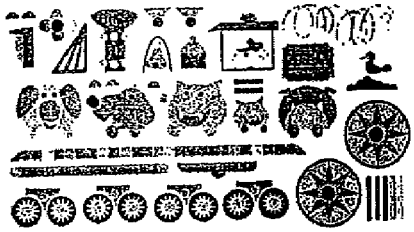
FIG. 6B
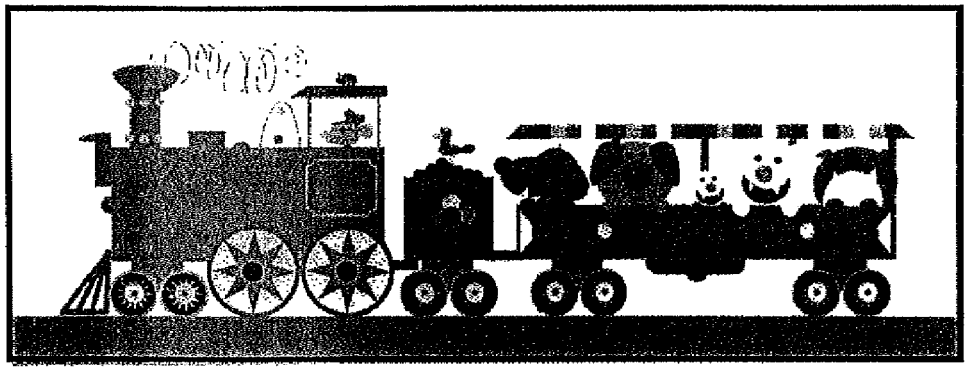
FIG. 6C

METHOD OF ADAPTING A PAINT TRANSFER IMAGE TO THE GENERATION OF A MURAL

CROSS-REFERENCE TO RELATED APPLICATIONS

This application is a divisional of pending U.S. patent application Ser. No. 10/847,435, filed May 17, 2004 now abandoned, which application is a continuation of abandoned U.S. patent application Ser. No. 10/308,231, filed Dec. 2, 2002 now abandoned, which application claims benefit of U.S. provisional patent application Ser. Nos. 60/337,907, filed Dec. 3, 2001 and 60/409,646, filed Sep. 10, 2002; all the prior patent applications are herein incorporated by reference in their entireties.

BACKGROUND OF THE INVENTION

1. Field of the Invention

The invention relates to methods for generating large-scale ornamentation such as a mural using optically integrated media.

2. Description of the Prior Art

Presently, murals and other ornamental imagery are generated using a skilled artisan whose function it is to paint upon a surface, such as the side of a building or an interior or exterior wall of a house, the image to be displayed.

SUMMARY OF THE INVENTION

The invention comprises a system and method for adapting a paint transfer image to the generation of a mural or other imagery.

Specifically, one or more regions of a wall or other structure are painted using respective colors such that demarcation points between the various regions are denoted by changes in color. A predefined image including image sub-elements of each color bordering the demarcation point is then applied using, for example, a paint transfer process (e.g., a "dry" transfer process). In this manner, the visual impact of both the painted portion and transferred portion of the resulting imagery is enhanced by the complementary nature of the respective colors. It is also noted that complementary textures may be advantageously employed in place of, or in addition to, the complementary colors.

A method according to one embodiment of the invention comprises: establishing a visual boundary between at least two surface color regions; and applying a dry transfer object proximate the visual boundary; wherein the dry transfer object comprising imagery having shading regions adapted to the at least two surface color regions; the dry transfer object-shading regions defining a visual boundary in substantial alignment with the surface color region visual boundary.

BRIEF DESCRIPTION OF THE DRAWING

The teachings of the present invention can be readily understood by considering the following detailed description in conjunction with the accompanying drawings, in which:

FIGS. 1-6 depict imagery useful in understanding the present invention.

To facilitate understanding, identical reference numerals have been used, where possible, to designate identical elements that are common to the figures.

DETAILED DESCRIPTION OF THE INVENTION

The subject invention will be primarily described in the context of disposing coatings such as paint and objects such as dry transfer decals upon the surface of the wall. However, it will be appreciated for those skilled in the art that the present invention is readily adaptable to any two or three-dimensional surface. As such, the term surface as used herein should be broadly interpreted as comprising any surface upon which a coating and dry transfer decal may be disposed.

Figure 1:
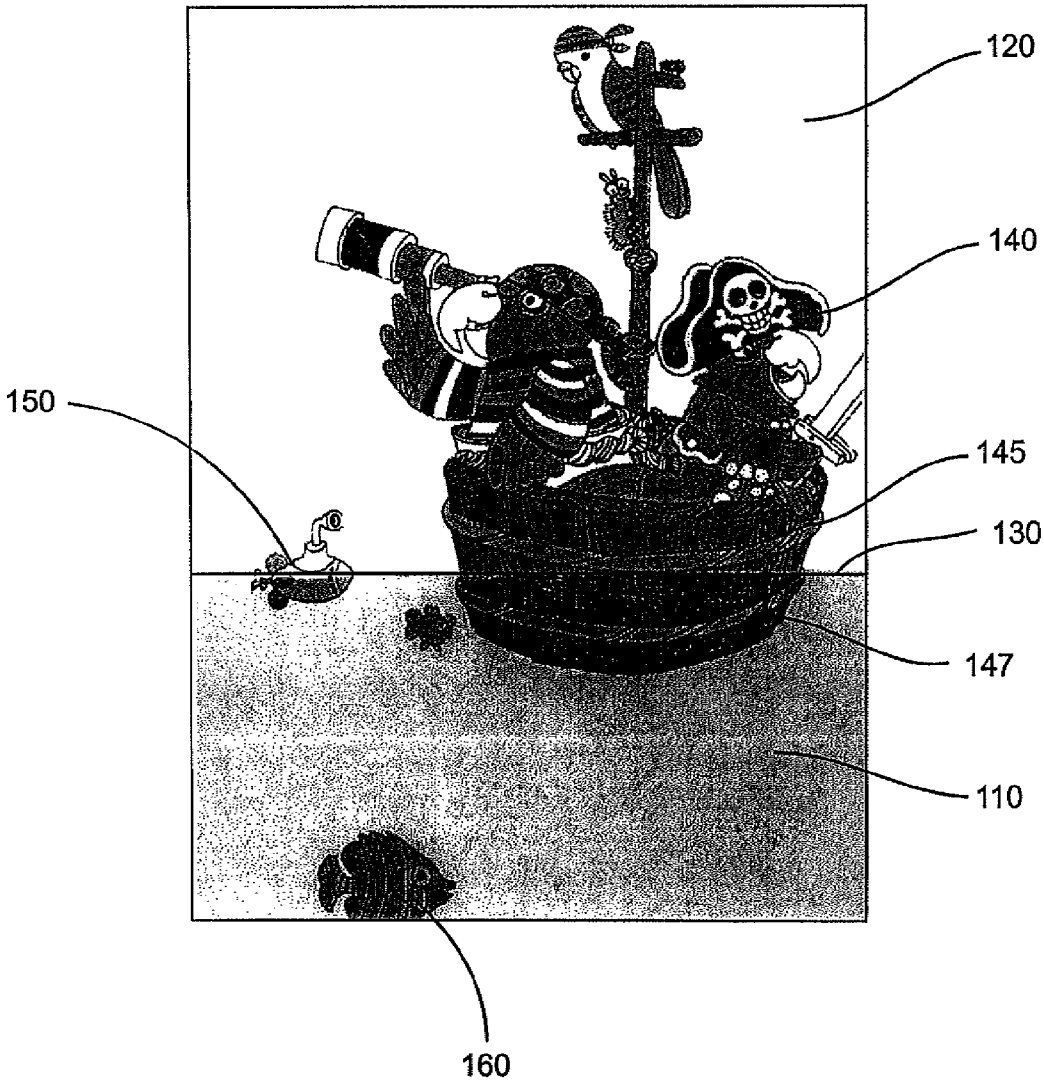
Figure 2A:
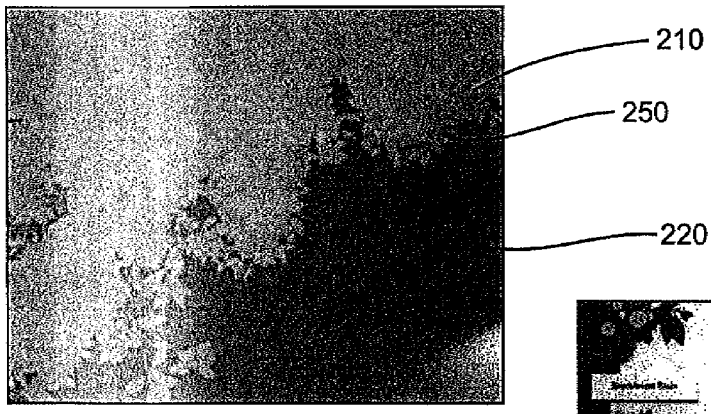
Figure 2B:
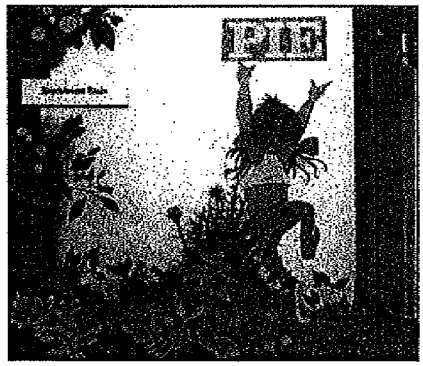
Figure 2C:
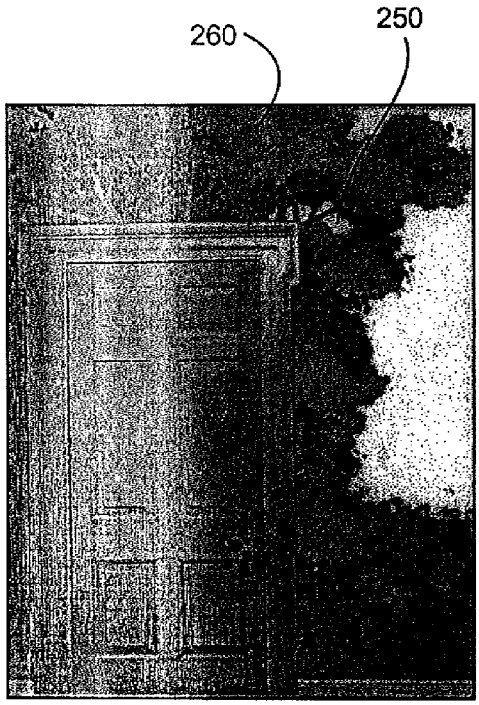
Figure 2D:
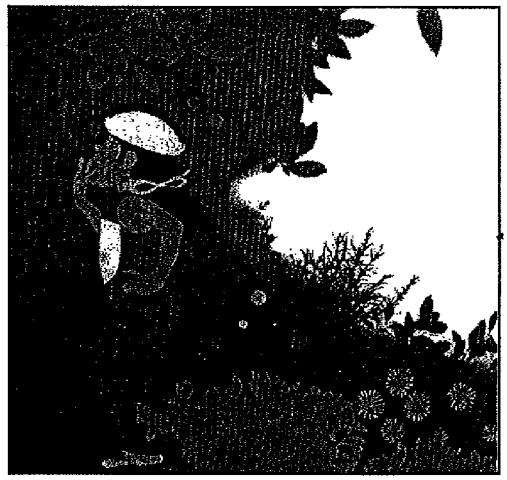

In FIG. 1, a first color region 110 and a second color region 120 meet at a demarcation line 130. The first color region 110 is a light blue shade reminiscent of water, while the second color region 120 is a pale shade reminiscent of sky. The demarcation line 130 visually indicates a water/sky interface line. A first object 140, illustratively some pirate-like creatures in a floating half-barrel is disposed upon the two color regions 110 and 120 along the demarcation line 130. That is, the object 140 includes a floating structure having shading reminiscent of (and complementary to) a barrel above water 145 and a barrel below water 147. A submarine shaped object 150 is also disposed upon the demarcation line 130 and includes shading appropriate to respective above water and submerged portions of a submarine. A fish shaped object 160 is fully located within the blue portion 110 and is shaded in a manner representative of a fish under water.

The FIG. 1 imagery achieves a believable visual effect by utilizing paint transfer or dry transfer objects having appropriate shading, coloring and/or textures with respect to a coating (e.g., paint) such that the object portions on the demarcation line 130 provide in a high quality and believable image.

The imagery discussed above with respect to FIG. 1 and below with respect to FIGS. 2-6 is primarily formed using ordinary house paint applied to a wall. The dry transfer decals and/or paint overlays are preprinted and intended to be used with paint of the particular color and/or texture applied to the wall. Thus, the bulk of the material (i.e., the paint) applied to a surface to produce the desired imagery comprises a first medium (paint) which is less expensive to use than a second medium (dry transfer products).

FIG. 2 depicts various imagery formed in accordance with the present invention. For example, as shown in FIG. 2A, a wall painted white 210 has painted over it a green portion 220. A compatible element 230 is disposed about the green portion 220 to create an image of trees. It is noted that the compatible element 230 is color-compatible with the white portion 210 of the wall. It should be noted that the compatible element 230 can also be made compatible with the green portion 220 of the wall if desired. Similarly, and referring to FIGS. 2B, 2C and 2D, white portions of a wall are augmented by decorative transfers. It is noted that the decorative transfers are compatible with the white portions and convey the particular impression.

The white portions of the wall operate to provide a "negative space" that cooperates with the dry transfer decal portions intruding into the white portions. Specifically, referring to FIG. 2C, it is noted that a white portion 250 bounded by green portions reminiscent of trees 260 defines therein a negative space giving the illusion of sky or atmosphere. The use of negative space wherein the negative space is generated using the inexpensive first medium (i.e., paint) and the boundary elements are generally using a more expensive second medium (i.e., dry transfer medium).

Figure 3A:
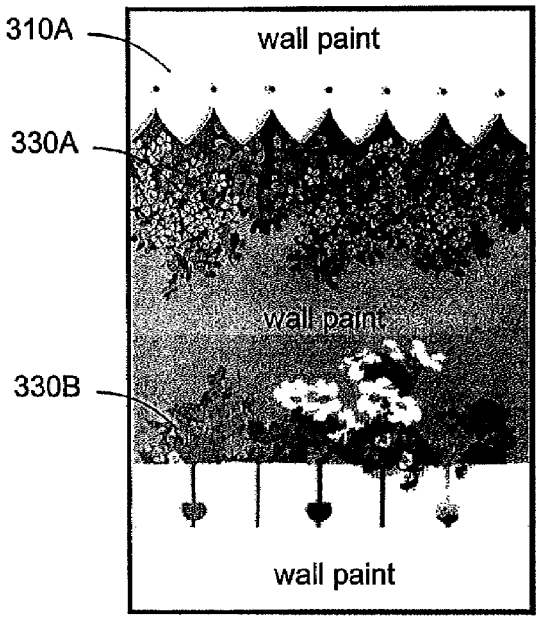
Figure 3B:
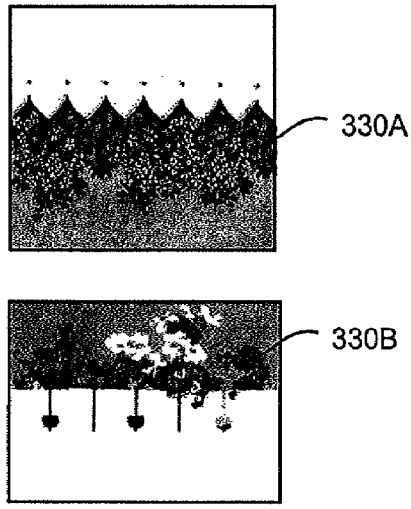
Figure 3C:
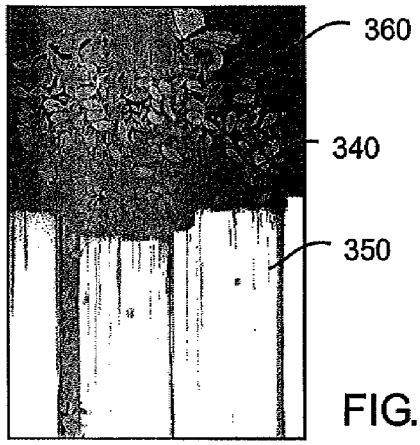

FIG. 3 depicts additional imagery formed according to the present invention. For example, FIG. 3A depicts a portion of a wall that is painted white in upper 310A and lower 310B regions, and painted blue 320 in a central region. The boundary between the upper 310A and blue 320 regions is modified by the application of a first paint transfer 330A, while the boundary between the lower 310B and blue 320 regions is modified by a second paint transfer 330B. The first 330A and second 330B paint transfers are individually shown in FIG. 3B. Of particular note is the optical functioning of the paint transfers to create imagery reminiscent of a fence with flowers emerging therefrom. Similarly, FIG. 3C depicts a wall having a white lower portion 350 and a blue upper portion 360 with a paint transfer 370 disposed therebetween to give an image of a fence in front of a row of hedges.

Figure 4:
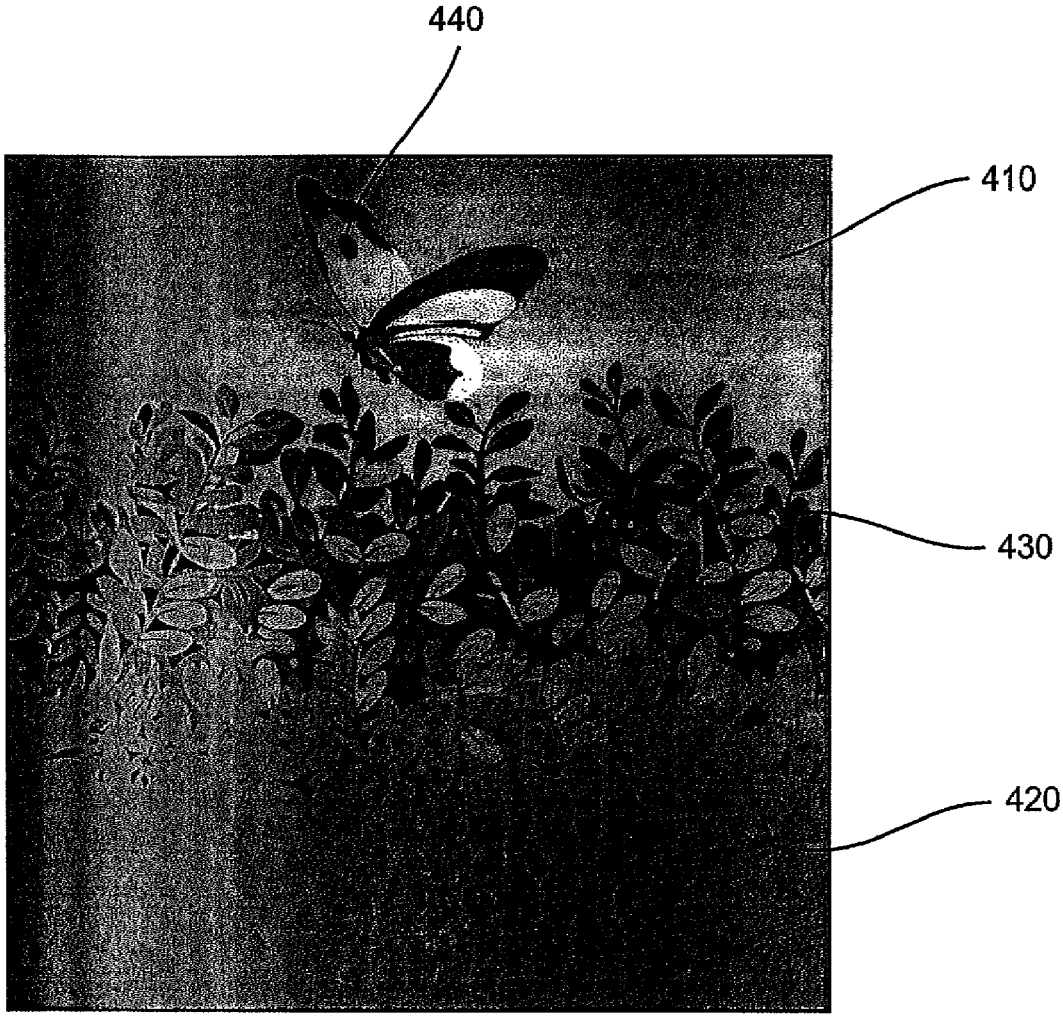
Figure 5:
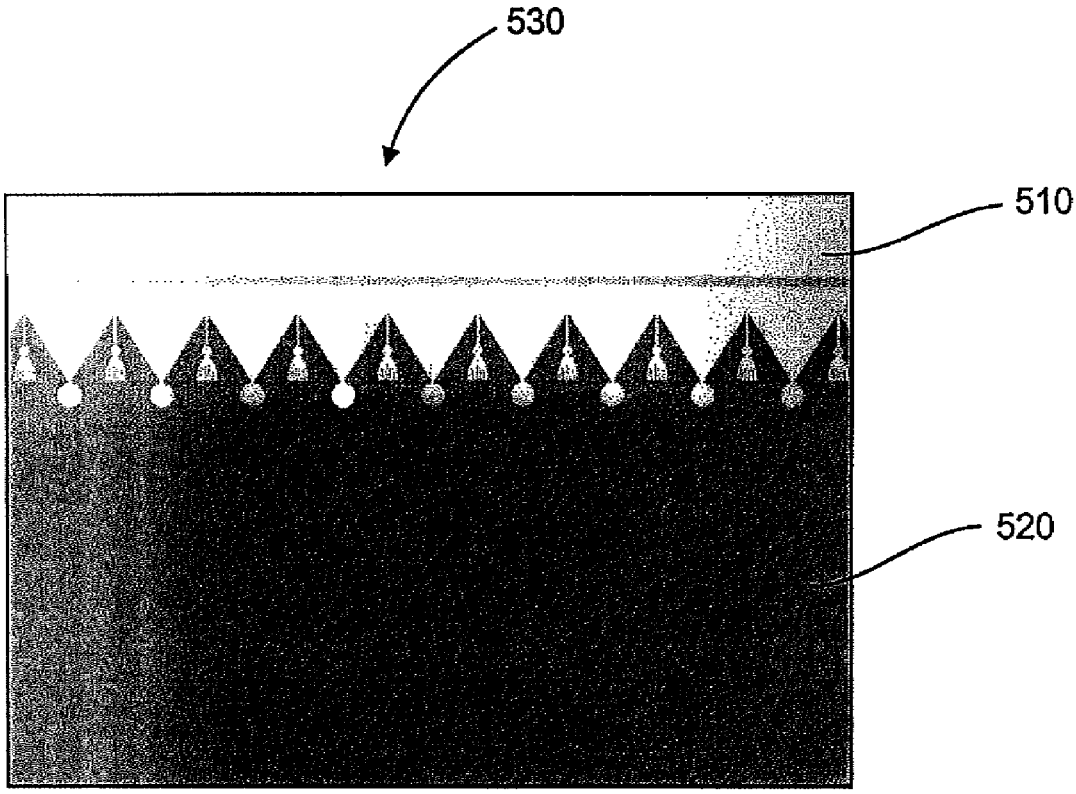

FIGS. 4 and 5 depict additional techniques adapted according to the present invention. Specifically, FIG. 4 depicts a first coating 410 reminiscent of sky or atmosphere, a second coating 420 reminiscent of deep color within the depicted hedge row, and a demarcation line obscured by a region of hedge row or leaf—reminiscent dry transfer imagery. It is further noted that the second or hedgerow-coated region 420 has included therein dry transfer imagery reminiscent of optical imperfections and other realistic hedgerow properties. A butterfly 440 is depicted as resting upon the dry transfer hedgerow top region 430. The butterfly 440 may be depicted using the same dry transfer or an additional dry transfer, such as placement of this decorative element may be controlled by the user.

FIG. 5 depicts a white region of, illustratively, a ceiling marching into a blue region of, illustratively, a wall and having disposed therebetween a dry transfer appliqué that gives a particular border effect. Specifically, the dry transfer appliqué conforms in color to the wall region color 520 to utilize the ceiling light color as a negative space which defines the border edge treatment 530.

FIG. 6 depicts a process for generating imagery according to the present invention. Specifically, referring to FIG. 6A, a wall 600 is painted white 640 and includes an orange object 610, a pink object 620, and two blue objects 630 and 650. These objects will be augmented by paint transfers to become portions of the final image. FIG. 6B depicts various paint transfers on a transfer sheet that will be used to augment the wall of FIG. 6A. It is noted that the colors of the objects on the paint transfer sheet are complementary to the colors painted on the wall 600 of FIG. 6A. For example, the orange block 610, which will be used to represent a train engine, is the same color as various portions of the train engine to be provided by the paint transfer sheet objects.

FIG. 6C depicts the final image wherein the paint transfer objects of FIG. 6B have been affixed to various locations on the wall 600 of FIG. 6A. The process described herein results in the use of relatively small amounts of paint transfer imagery, such that associated costs are kept low. This is achieved by using matching paint colors to provide for large expanses of the imagery on the wall.

The subject invention advantageously provides the ability to rapidly create ornate and/or complicated imagery. The subject invention utilizes a blending technique wherein the superposition of one dry transfer decal over another dry transfer decal (or over an appropriately shaded/colored painted surface) provides a virtually imperceptible blending between the various elements. This cumulative effect of these virtually imperceptible blendings of different decorative elements (i.e., paint, dry transfers, dry transfer decals and the like) provide for a versatile method of executing large-scale imagery and/or small scale imagery. Moreover, in difficult surface portions, such as corners, around doors and windows, near floors or ceilings and the like, the blending of many elements to form imagery in a substantially seamless manner allows the use of specific elements that are particularly appropriate to the proximate surface.

In one embodiment of the invention, a kit is provided which includes all of the paint and dry transfer decals necessary to create a desired image. For example, referring to FIG. 3, a kit adapted to providing the flower and fence imagery comprises paint having a color and, optionally, a texture compatible with direct transfer imagery representing the flower and hedge design. It is assumed that the purchaser utilizes a white paint as a base coat. The dry transfer imagery is disposed proximate the boundary between the white base coat and portions of a wall painted with the included compatible paint. In this manner, the representation of large relatively monochrome portions of the image are executed using paint, while detailed portions of the image and those portions proximate the color border region are executed using dry transfer decal. This approach minimizes cost and time to execute the mural.

The subject invention operates to disguise the boundary region wherein a color attributable to paint ends and a color to attributable to a dry transfer begins, thereby creating illusion that a wall is "hand painted." The paint transfers are designed such that they are visually seamlessly feathered into the body of the wall paint, thereby creating an edge region of a mural.

While foregoing is directed to the preferred embodiment of the present invention, other and further embodiments of the invention may be devised without departing from the basic scope thereof, and the scope thereof is determined by the claims that follow.

The invention claimed is:

1. A method for generating a mural on a surface, the mural including a plurality of decorative elements, the method comprising:

applying paint of a first color to at least one region of the surface to provide thereby a first color region of the surface;

applying paint of a second color to at least one region of the surface adjacent to the first color region of the surface to provide thereby a second color region of the surface; and transferring a dry transfer object from a paint transfer medium to a region of the surface overlapping portions of the first and second color regions of the surface, the dry transfer object comprising paint imagery including a first color portion having the same color as the first color of the painted surface to define thereby a visual boundary between the first color region of the painted surface and the second color region of the painted surface;

wherein at least one decorative element of the mural is defined by the visual cooperation of the painted first color region of the surface and the first color portion of the dry transfer object.

2. The method of claim 1, wherein the dry transfer object includes at least one negative space portion to provide visibility of the painted surface through the dry transfer object.

3. The method of claim 1, wherein:

said transferring comprises transferring a plurality of dry transfer objects from the paint transfer medium to the painted surface.

4. The method of claim 3, wherein said plurality of dry transfer objects cooperate with colors on the painted surface to provide respective elements of a mural.

5. The method of claim 3, wherein said plurality of dry transfer objects are provided using multiple sheets of said paint transfer medium.

6. The method of claim 1, wherein said paint transfer medium is adapted to impart a texture to the dry transfer object, the texture imparted to the image being adapted to coordinate with a texture of the painted surface.

7. The method of claim 1, wherein said first surface color surface is proximate said second surface color, and said paint imagery represents an ornamental arrangement disposed therebetween.

8. The method of claim 7, wherein said paint imagery also includes imagery disposed over said second surface color to define thereby a visual structure using negative space.

9. The method of claim 1, wherein the transferrable image includes a plurality of image regions having respective colors and imagery adapted to form a mural upon the painted surface by selectively hiding and delineating portions of the painted surface.

10. The method of claim 9, wherein a first region of said image includes a first color that is the same as a painted surface color such that a transition between the first color of said painted surface color tends to be hidden.

11. The method of claim 9, wherein a second region of said image includes a second color having an image position delineating an image boundary to visually define thereby a third image region.

12. The method of claim 1, wherein said surface comprises a wall.

13. The method of claim 1, wherein said surface comprises a three dimensional surface.

14. The method of claim 1, wherein said texture imparted to the image being adapted to coordinate with a house paint texture.

15. A method for generating a mural on a surface, the mural including a plurality of decorative elements, the method comprising:

establishing a visual boundary between a painted region of said surface having a first color and a painted region of said surface having a second color; and applying a dry transfer object proximate said visual boundary, said dry transfer object comprising paint imagery including a first color portion having the same color as the painted first color region of the surface and shaped to define a visual boundary between a portion of the painted first color region of the surface and a portion of the painted second color region of the surface;

wherein at least one decorative element of the mural is defined by the visual cooperation of the painted first color region of the surface and the first color portion of the dry transfer object.

16. The method of claim 15, wherein said painted surface color regions comprise respective painted portions of a wall.

17. The method of claim 15, wherein said first color portion of said paint imagery includes a decorative element having a color different than said first painted surface color region.

18. The method of claim 15, wherein:

said two painted surface color regions comprise respective portions of a wall; and said paint imagery disposed upon said surface provides thereby a mural.

19. The method of claim 15, wherein:

said paint imagery overlaps said two painted surface color regions; and said first and second surface color regions extend to demarcation points therebetween, said paint imagery being applied along said demarcation points.

20. The method of claim 19, wherein said paint imagery also includes imagery within said second painted surface color region to define thereby a visual structure using negative space.

* * * * *

UNITED STATES PATENT AND TRADEMARK OFFICE

CERTIFICATE OF CORRECTION

PATENT NO. : 8,083,882 B2
APPLICATION NO. : 12/835792
DATED : December 27, 2011
INVENTOR(S) : Jerry Rosenfeld It is certified that error appears in the above-identified patent and that said Letters Patent is hereby corrected as shown below:

IN THE CLAIMS:

Column 4, claim 7, line 2, delete "surface" (first occurrence).

Signed and Sealed this
Twenty-first Day of February, 2012

David J. Kappos

David J. Kappos
*Director of the United States Patent and Trademark Office*